United States Patent [19]

Göransson et al.

[11] 4,108,933

[45] Aug. 22, 1978

[54] METHOD OF MANUFACTURING STEAM-CURED POROUS CONCRETE PRODUCTS

[75] Inventors: Rolf Erik Göransson, Åkarp; Gösta Harald Eriksson, Södertälje; Öystein Kalvenes, Grödinge; Percy Svensson, Rönninge, all of Sweden

[73] Assignee: Internationella Siporex AB, Malmo, Sweden

[21] Appl. No.: 782,219

[22] Filed: Mar. 28, 1977

[30] Foreign Application Priority Data

Apr. 6, 1976 [SE] Sweden ..... 7604016

[51] Int. Cl.[2] ..... B20B 3/00

[52] U.S. Cl. ..... 264/42; 214/6 A; 214/6 FS; 264/82; 264/90; 264/158; 264/333

[58] Field of Search ..... 264/88, 90, 157, 335, 264/82, 158, 333, 42; 214/6 A, 6 FS

[56] References Cited

U.S. PATENT DOCUMENTS

| | | | |
|---|---|---|---|
| 3,594,462 | 7/1971 | Vrijma | 264/90 |
| 3,751,544 | 8/1973 | Smorenburg | 264/157 |
| 3,919,372 | 11/1975 | Vogele | 264/157 X |

*Primary Examiner*—Thomas P. Pavelko
*Attorney, Agent, or Firm*—Fred Philpitt

[57] ABSTRACT

The present invention is concerned with a method of manufacturing porous concrete products in which there is first formed an at least approximately parallelepipedic body of concrete mass which is plastic at a given stage but still shape permanent, whereafter said body resting on a first support surface, while the concrete mass is still plastic, is divided into a multiplicity of slabs by means of horizontal cuts, the thickness of each slab being much smaller than the original height of the body, whereafter a multiplicity of the thus obtained slabs are charged to an autoclave in which they are steam-cured in a group resting on a further support surface. The invention is characterized in that one slab at a time is lifted from the remaining body resting on the first support surface and is transferred, while being turned through 90°, to the further support surface on which surface the transferred slabs are placed on one long-side edge thereof in mutually spaced apart relationship.

4 Claims, 6 Drawing Figures

METHOD OF MANUFACTURING STEAM-CURED POROUS CONCRETE PRODUCTS

Figure 1:
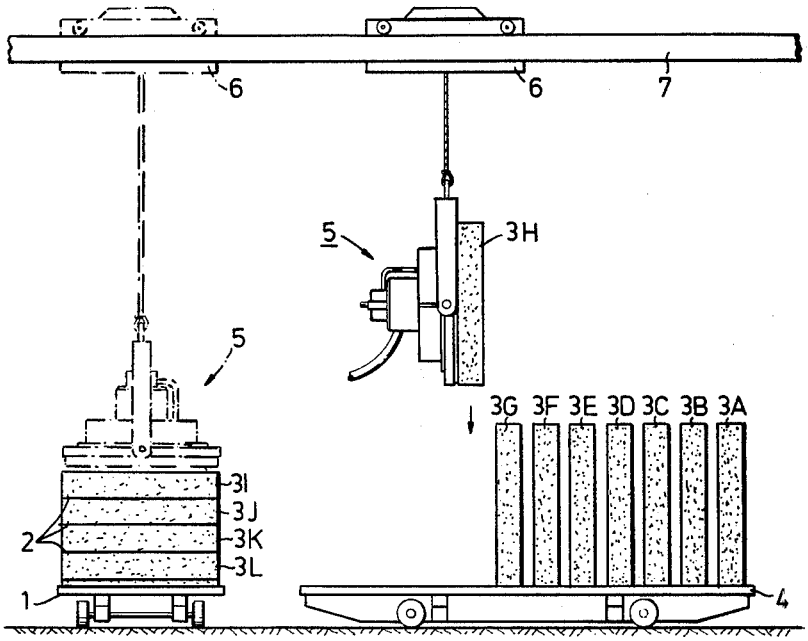

The present invention relates to the manufacture of porous concrete products in which there is first formed a substantially parallelepipedic porous body of concrete mass which at a given stage is plastic but nevertheless shape permanent, and in which, with the body resting on a first support surface with concrete mass still in a plastic state, said body is divided into a multiplicity of slabs by cutting said body horizontally, each of said slabs having a thickness which is considerably smaller than the original height of the body, whereafter a multiplicity of the thus obtained slabs are charged to an autoclave in which they are steam-cured in a group.

When this known method of manufacture is applied in its original form, the horizontal cuts, at least in the lower portion of the body, are unavoidably so close together that contacting surfaces of the still plastic concrete mass adhere to each other or are entrained by each other, particularly when the concrete mass is relatively soft when being cut and having a composition such as to enhance the adhereing tendency of the concrete. When the slabs are subsequently steam-cured, placed one upon the other, the mutually contacting adhesive surfaces of adjacent slabs often stick together, the bond between the different slabs often being so strong that said slabs must be forcedly separated one from the other, which is liable to damage the slabs. Moreover, the necessity of introducing an additional working step in order to break apart products which, in a previous step, have been separated from each other by a cutting operation, is naturally an undesirable task.

In order to eliminate this disadvantage, it has been proposed to turn or tip the cut body prior to steam-curing the same, which body comprises a stack of superimposed slabs, onto a further support surface in a manner such that the cuts which were previously horizontal are now vertical. It was believed that in this way there would be obtained at least a weaker bond between the slabs, since they no longer rested directly one upon the other during the steam-curing operation. No real difference was obtained, however, since adhesion of the slabs cut from the body had already begun to take place before the slabs were placed on their sides on the further support surface, and the bond between adjacent slabs as a result of adhesion therebetween was finally fixed during the steam-curing operation as with the previous method.

In accordance with the invention there is proposed a more comprehensive but also a more effective solution of this problem, in which solution one slab at a time is lifted from a residual body resting on the first support surface and placed on the further support surface whilst being turned through 90°, the transferred slabs being placed on said further support surface in mutally spaced relationship on one long side of said slabs. In this way the bond between the slabs is broken before the steam-curing operation, whilst at the same time the two broadsides of each slab are influenced by the steam during said curing operation. This optimises the curing sequence, eliminates those thermal tensions which readily occur when large coherent bodies are steam-cured — irrespective of whether said bodies are cut or not — and provides a satisfactory steam-curing result, even without the autoclave being evacuated prior to the steam-curing operation. Furthermore, each of the slabs transferred from the first to the further support surface may be monitored individually and subjected to other treatment.

Figure 2:
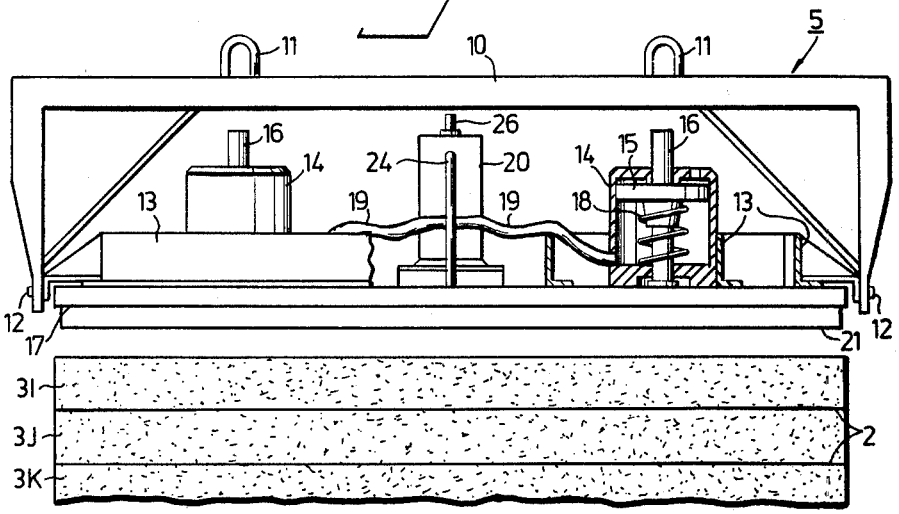

An embodiment of the method will now be described with reference to the accompanying drawing, this description also including means for putting the method into effect. FIG. 1 is a greatly simplified end view of part of an apparatus for producing stem-cured porous concrete products in which slabs are moved from a first to a second suppport surface in lifting and transferring steps characteristic of the invention, while FIG. 2 is a partially cut away front view, in larger scale, of the apparatus shown in FIG. 1 for gripping and transferring the slabs. FIGS. 3–6 are cross-sectional views of said apparatus during different working stages, said sections being assumed to be taken through a schematically illustrated valve mean which is incorporated in said apparatus and which controls its operation.

In FIG. 1 the reference 1 identifies a carriage which has been loaded with substantially parallepipedic porous bodies of concrete mass in a preceding station (not shown) of a plant in which porous concrete products are manufactured, which concrete mass is, at a given stage, plastic but nevertheless shape permanent. Although not necessary, the porous concrete body is often cast directly on the carriage 1. The body resting on the carriage 1, whilst still in a plastic state, is subsequently divided by horizontal cuts 2 into a multiplicity of slabs 3A–3L, the thickness of each slab being considerably smaller than the original height of the body. Originally these slabs 3A–3L lie on top of each other, but as shown in the figure each slab is subsequently lifted from the underlying slab or slabs on the carriage 1 and transferred whilst being turned through 90° to a further support surface 4 which also has the form of a carriage, on which carriage slabs 3A–3G have already been placed on one edge thereof in mutually spaced apart relationship, the remaining slabs on the carriage 1 being subsequently transferred to said carriage 4 and placed in the same spaced apart relationship resting on one long edge surface. The slabs 3A–3L resting on one of their edge surfaces in spaced relationship on the carriage 4 are then charged to an autoclave, not shown, in which the slabs are steam-cured in a group whilst resting on said carriage. Each of the slabs 3A–3L is lifted, turned and transferred suitably by means of apparatus such as that generally shown at 5, said apparatus being carried on a traverse carriage 6 and arranged to be raised and lowered, said carriage being moveable along fixed rails 7. It will be understood, however, that the apparatus 5 need not necessarily move, since it is conceivable that the carriages 1 and 4 are moved and raised and lowered respectively As shown in FIGS. 2–6, the apparatus 5 may suitably comprise a yoke 10 provided with attachment lugs 11 for attaching support lines from the carriage 6 and which, via coaxial and horizontal pins 12 between their downwardly extending limbs, support a frame structure 13. Fixedly mounted in said frame structure is a pair of cylinders 14, the pistons 15 which actuate, via piston rods 16, a common suction device 17. The piston 15 is moveable in its respective cylinder 14 against the action of a return spring 18 which biasses the suction device 17 into abutment with the underside of the frame structure 13. The space above the piston 15 is a respective cylinder 14 is in open communication with ambient air and the lower part of the cylinder is connected to a valve means 20 via a flexible line 19, said valve 20 being arranged centrally on the suction device 17 and thus accompanies movement of said device relative to the frame structure 13.

Extending circumferentially on the underside of the suction device 17 is a soft air-impermeable edge sealing strip 21, which may be made of foam rubber for example, and radially inwardly thereof a suction surface 22 in which a series of mutually communicating grooves or channels are formed. In turn these grooves or channels communicate with a chamber 23 in the interior of the suction device 17 via open holes, which chamber is connected through a line 24 with the valve means 20. The valve means can be alternatively connected through a further line 25 with a source of partial vacuum (not shown) or with the ambient atmosphere, for example by means of a manually-operated switching valve. A system of valve plates incorporated in the valve means 20 is controlled mechanically by means of an arrangement comprising a sensing foot 27 carried on one end of a spring-actuated valve spindle 26 and being active on the undersurface of the suction device 17.

Figure 3:
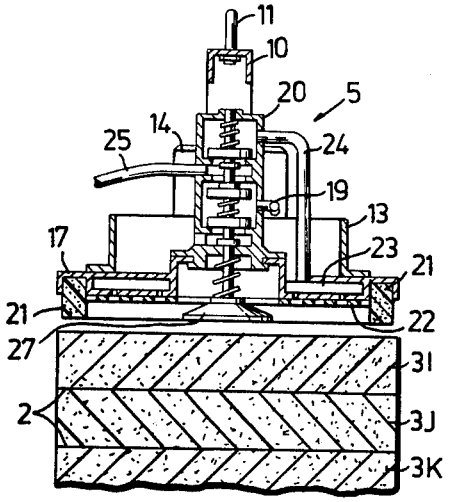
Figure 4:
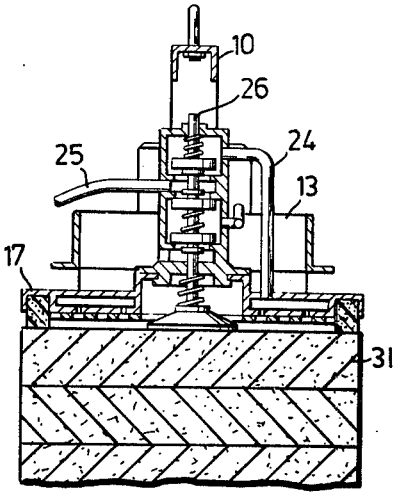
Figure 5:
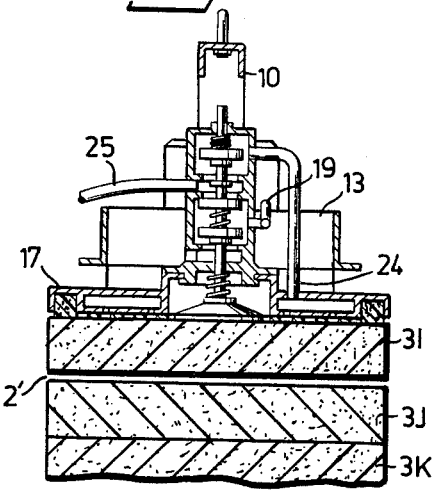
Figure 6:
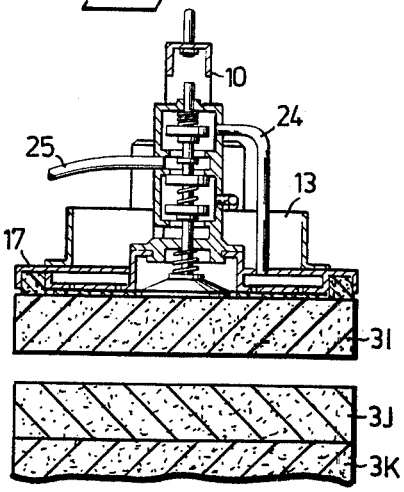

When using the described apparatus 5, the yoke 10 and the frame structure 13 pivotally connected therewith is lowered to an fixed in a first position relative to the upper surface of the top slab 3*i* on the carriage 1, in which first position the suction device 17 is not yet in contact with the upper surface of the slab, as shown in FIG. 3. The line 25 is then connected to a source of partial vacuum. This partial vacuum causes th pistons 15 in the two cylinders 14 to move downwardly, thereby causing the suction device 17 to be lowered relative to the frame structure 13, as shown in FIG. 4. The edge-sealing strip 21 of the suction device will then lie against the upper surface of the slab 31, and the sensing foot 27 on the valve spindle 26 will break the connection between the source of partial vacuum and the cylinders 14 so as to stop the lowering of the suction device. At the same time, however, the connection between the lines 24 and 25 is opened, which causes the suction device to be evacuated. As a result hereof the slab 31 is lifted from the underlying remaining part of the cut body, as shown in FIG. 5, whereupon the cut lying immediately beneath the slab 31 is transformed to an open air gap 2'. When the slab 31 is sucked against the suction surface22 of the suction device 17, the edge sealing strip 21 is compressed to a maximum and, at the same time, the valve means is reactivated so that the lines 19 to the cylinders 14 are connected to atmospheric pressure. As a result hereof, the springs 18 in the cylinders return the suction device 17 to its original position relative to the same frame structure 13 whereupon the slab 31 is lifted through a further distance, as shown in FIG. 6.

Subsequent to moving the apparatus 5 laterally and/or adjusting the vertical position of said apparatus, the frame structure 13 together with the suction device 17 and the slab held thereby are swung relative to the yoke 10 around the horizontal pins 12 so that the slab adopts a vertical position, in which position the slab can be placed on the carriage 4 by means of the apparatus. Although the slab of porous concrete mass is only in frictional engagement with the suction surface 22 when the apparatus is turned to the position shown in full lines in FIG. 1, it is normally sufficient to create in the suction device a subpressure corresponding to merely some meters of water column. As soon as the slab has been placed in its intended position on the carriage 4, the connection between the line 25 and the source of partial vacuum is broken, at the same time as the line 25 is connected to atmospheric pressure. The suction device 17 will then immediately release the slab and is pushed away from said slab so that, subsequent to falling back to a horizontal position, it is ready to collect a further slab from the first support surface 1.

The described apparatus 5 affords particular advantages with respect to handling preferably thin slabs of porous concrete mass. The concrete mass is namely not fully impervious to air and hence two or more slabs may accompany each other during the lifting operation. This is effectively prevented if, in the manner aforedescribed, the suction device is permitted to stop in a position in which the slab, which is to be lifted, is lifted and thereby separated from the remainder of the porous concrete body at the movement when the slab is sucked against the suction surface of the suction device. When the apparatus is to lift and to transfer much thicker slabs, in which the air permeability of the porous concrete will not present any serious problem, any suitable apparatus can be used, although preferably such apparatus as that operating with a partial vacuum, provided that said apparatus will permit the slab to be turned through 90° about a horizontal axis.

We claim:

1. A method of manufacturing steam-hardened cellular concrete slabs comprising the steps:

(a) molding from a concrete mass a cellular body of at least approximately parallelepipedic shape that in a certain stage of solidification of the mass is self-supporting but still capable of being cut into regular pieces, (b) making a plurality of vertically spaced, horizontally extending cuts in said body while the same is resting on a first support to thereby divide said body into a plurality of slab-forming slices, (c) removing said slices one-by-one by lifting away from said first support the body slice that from time-to-time is the uppermost one, (d) canting said lifted slices and depositing them in succession in their canted position in side-by-side but mutually spaced relationship on a second support, so that their broad sides are exposed for subsequent steam contact, and (e) forwarding said second support with the canted body slices thereon into an autoclave, in which the slices are subsequently steam-hardened to form the desired slabs.

2. The method as claimed in claim 1, wherein said vertically spaced, horizontally extending cuts in said body are all made before any one of the slice is removed from said first support.

3. The method as claimed in claim 1 wherein said body slices are removed one-by-one from said first support by means of a movable gripping device operative as a suction head, the upper face of each body slice to be removed being caused to adhere by suction to a backing surface on said gripping device, and wherein canting of said lifted body slices is effected by swinging said gripping device together with the body slice carried thereby through 90° about a horizontal axis.

4. The method as claimed in claim 3 wherein each body slice to be removed from said first support is separated from any remainder of the body resting on said support by being elevated from such body remainder by suction exerted through said gripping device before coming into contact with said backing surface of said gripping device.

* * * * *